US005309065A

United States Patent [19]

Nuckolls et al.

[11] Patent Number: 5,309,065

[45] Date of Patent: May 3, 1994

[54] VOLTAGE DOUBLER BALLAST SYSTEM EMPLOYING RESONANT COMBINATION TUNED TO BETWEEN THE SECOND AND THIRD HARMONIC OF THE AC SOURCE

[75] Inventors: Joe A. Nuckolls, Blacksburg, Va.; Yan Wang, Northbrook, Ill.

[73] Assignee: Hubbell Incorporated, Orange, Conn.

[21] Appl. No.: 841,844

[22] Filed: Feb. 26, 1992

[51] Int. Cl.[5] ..... H05B 37/00; H05B 39/00

[52] U.S. Cl. ..... 315/205; 315/289; 315/290; 315/244; 315/241 R; 315/DIG. 5; 315/232; 363/61

[58] Field of Search ..... 315/205, 289, 290, 250, 315/283, 232, 244, 245, 241 R, DIG. 5; 363/61, 108

[56] References Cited

U.S. PATENT DOCUMENTS

| | | | |
|---|---|---|---|
| 3,233,148 | 2/1966 | Lake | 315/205 |
| 4,117,377 | 9/1978 | Jimerson et al. | 315/205 |
| 4,480,214 | 10/1984 | Sodini | 315/290 |
| 4,701,673 | 10/1987 | Lagree et al. | 315/232 |
| 4,866,347 | 9/1989 | Nuckolls et al. | 315/158 |
| 5,047,694 | 9/1991 | Nuckolls et al. | 315/290 |

*Primary Examiner*—Paul M. Dzierzynski
*Assistant Examiner*—Michael B. Shingleton
*Attorney, Agent, or Firm*—Oblon, Spivak, McClelland, Maier & Neustadt

[57] ABSTRACT

A ballast circuit system provides for efficient starting and operation of high voltage discharge lamps using a common 120 volt AC power source. As a result of this improved ballast circuit system, the necessary high voltage is generated from a normal 120 volt AC in such a way that there is low power loss. The system efficiency allows for use of plastic fixtures and small size packaging of the discharge lamp.

12 Claims, 5 Drawing Sheets

VOLTAGE DOUBLER BALLAST SYSTEM EMPLOYING RESONANT COMBINATION TUNED TO BETWEEN THE SECOND AND THIRD HARMONIC OF THE AC SOURCE

BACKGROUND OF THE INVENTION

1. Field of the Invention

The present invention relates to an improved small size low loss ballast system for starting and operating high voltage discharge lamps using commonly supplied 120 volt power sources.

2. Discussion of the Background

The prior art contains many examples of starting circuits for gaseous discharge lamps or electric discharge lamps. Most of these circuits provide a ballast circuit involving a transformer in series with the load. The prior art circuitry vary depending upon the exact nature of the electric discharge lamp, i.e., fluorescent, metal halide, high pressure sodium vapor lamp (HPS) etc. With improvements in the construction of the gaseous discharge lights themselves, have come associated problems with providing ballast circuitry. These problems result from the development of efficient high voltage discharges which must have a small size, low loss ballast and yet be able to be operated from 120 volt power sources.

One prior art solution enabling the use of 120 volt power source was the low wattage HPS (high pressure sodium) lamps which have a requirement for an operating voltage of around 55 volts so that a 120 volt reactor ballast can be used plus an electronic ignitor. However, these HPS lamps require higher amperage because HPS lamps require high volt-amps for a given lamp wattage. That is for example, a 50 watt HPS has a requirement for 52 Vx 1.18A=61.4 VA. The higher amperage causes higher losses and thus a larger size device needs to be constructed.

The current trend in electric discharge lamps is to produce systems which have total higher efficiency and which produce "white light". With this higher efficiency comes the requirement for a higher operating voltage and when voltage step up is required in addition to ballasting, the physical size of the structure becomes a problem and the losses become excessive because of the requisite high temperatures. These high temperatures particularly effect the use of plastic fixtures in the devices for the lamp.

SUMMARY OF THE INVENTION

Accordingly, it is one object of the present invention to provide a low loss ballast for a high voltage discharge lamp which is able to be small in size and can operate from commonly supplied 120 volt power sources.

It is a further object of the present invention to provide an electronic circuit functioning from a 120 volt input which uses low cost, market available parts and which ignites, stabilizes and operates a high voltage metal halide (MH) lamp effectively.

The above objects are accomplished by an electronic circuit having a ignitor system designed to operate with DC ripple voltage and a discharge capacitor in combination with a radio frequency choke and a current limiter resistor functioning in conjunction with a SIDAC breakdown semiconductor switch and a high voltage pulse transformer. The voltage supplied to the ignitor circuit is generated from a ballast circuit receiving an AC supply of 120 volts.

It is a further object of the present invention to provide a ballast circuit in conjunction with an ignitor circuit in such a way so as to control the resonant point of the ballast circuit itself in order to enhance stable operation by avoiding the odd harmonic resonant point. Therefore, the unloaded condition voltages appearing across the capacitors of the ballast circuit are increased by enhancing the "Q" factor of the circuit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
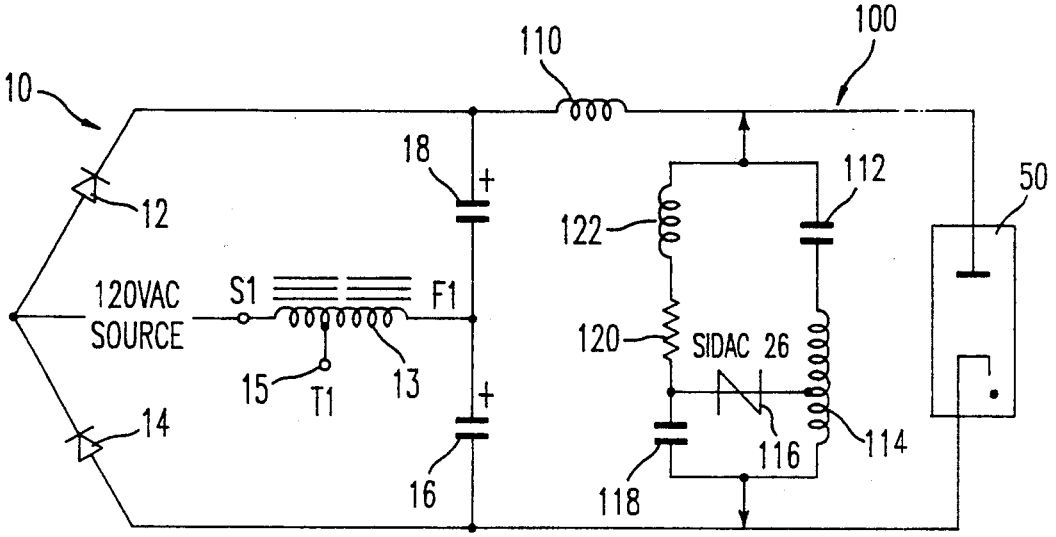
FIG. 1 is a circuit diagram of the ballast circuit and ignitor coil according to one embodiment of the present invention.

Referring now to the drawings, wherein like reference numerals designate identical or corresponding parts throughout the several views, and more particularly to FIG. 1 thereof, there is shown a ballast 10 and ignitor circuit 100 structure for a 50 watt metal halide lamp operation. The ballast portion 10 of the circuit of FIG. 1 utilizes a normal 120 volt AC source whose positive going voltage charges through the diode 12 as well as the inductance 13 in order to charge the capacitor 18. In a similar manner the negative voltage functions through diode 14 and the inductance in order to charge capacitor 16 so that the voltage between points 1 and 2 of the ignitor circuit is 340 volts DC which is equal to 2 times the peak of the 120 volt input. This open circuit voltage applies when no load current is flowing. Thus, the high voltage, limited energy producing discharge capacitor 118 in the ignitor circuit 100 is charged from the positive DC voltage anode line of pt. 1 through the radio frequency choke 122 and through the charging resistor 120 in order to charge capacitor 118 to the value of the breakdown voltage of the SIDAC 116 (e.g., 240 volts). Thus the charging resistor 120 acts as a current limiting resistance when the SIDAC 116 fires. When the SIDAC semiconductor switch 116 closes at breakdown, 240 volts are placed across the primary turns of the high voltage pulse transformer 114 and is amplified by means of the turns ratio up to between 5 and 7 KV. At this time the choke 122 and the choke 110 act as open circuits to allow the high voltage pulse to exist across the lamp which ionizes the "fill gas". Then the 340 volt DC across the series connector capacitors 18 and 16 act to discharge those capacitors through the current smoothing choke 110 and forces the lamp into a low impedance state which allows it to be energized from the normal 120° cycle ballast energy delivery system.

The capacitor 112 serves to couple the high voltage, high frequency pulse and to effectively block the 120 Hz and D-C current flow in the winding 114. The charging resistance 120 is increased because it is driven by DC voltage so AC synchronization is not required. The increase is such that the magnitude of the charging resistance 120 limits its wattage dissipation during repeated pulsing and a failed-open lamp condition. Once the lamp 50 starts and the starter is loaded, the voltage is decreased to approximately 100 volts and the starter is automatically disabled until the next time an open circuit voltage reappears to once again drive it into operation.

Figure 2:
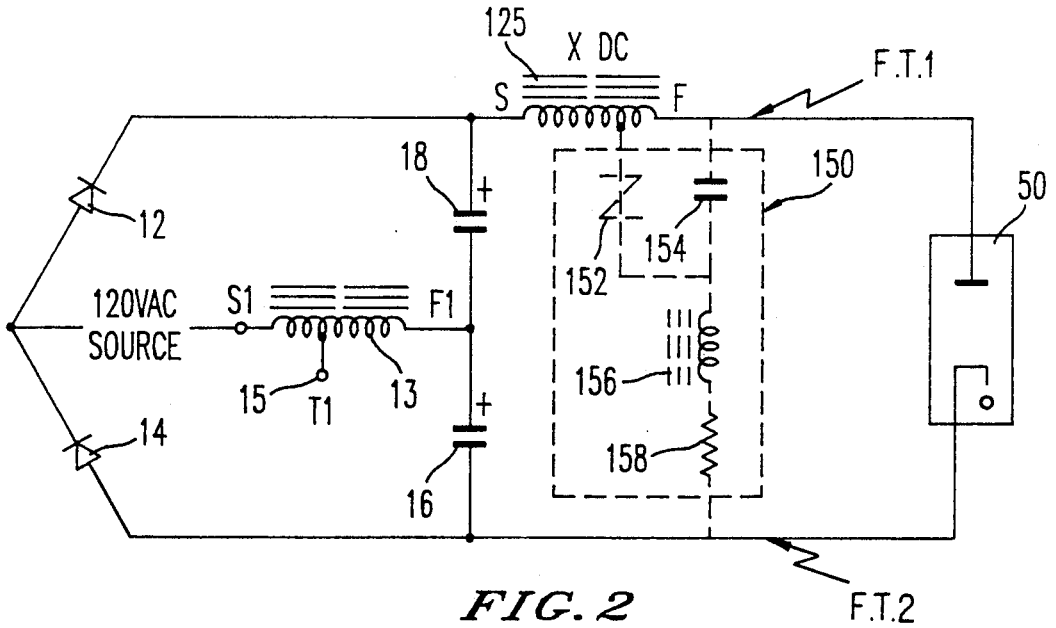
FIG. 2 is a circuit diagram of the ballast circuit in conjunction with an alternate embodiment of an ignitor circuit.

The FIG. 2 shows an alternate embodiment for the ignitor circuit using the same ballast circuit 10 as in FIG. 1. The ignitor circuit 150 of FIG. 2 uses a tapped choke 125 connected to the SIDAC 15 with the other output of the SIDAC being connected to the capacitor 154 which is in turn in series with the resistor 158 and the inductance 156. The operation of the ignitor circuit 150 of FIG. 2 is similar to the operation of the ignitor circuit of FIG. 1.

An automatic starting-circuit turn-off feature at lamp failure can be easily added to the starter circuits of FIGS. 1 and 2 by shunting a small negative temperature coefficient component across 118 or 154. This negative temperature coefficient component heats u after several minutes of normal pulsing and provides a drop in resistance to a magnitude which bleeds off the voltage on 118 or 154 which has built up so that the breakdown voltage of the SIDAC is not reached and heating current of 340 volts continues to flow through the negative temperature coefficient component (thermistor) thus keeping it in its low resistance state until the fixture is de-energized.

The operation of the ballast circuit portions of FIGS. 1 and 2 is shown diagrammatically in FIG. 3 wherein, the AC supply is shown in its positive plurality mode and subsequently the half cycle sign wave peak is 170 volts for a 120 volt supply. The positive going voltage drives a charging current IChl through the diode 12 and the ac inductance 13 to charge the capacitor 18 to the 170 volt level.

The resonant frequency of inductance 13 and capacitance 18 (18 has a capacitance equal to 16) is chosen to be in the range of 130 to 165 Hz which is spaced from resonance points such as the third harmonic 180 Hz. The placement of the resonant frequency is accomplished in order to prevent resonant charging of 18 and 16 which would lead to an unstable circuit operation (lamp flicker, etc.). The instability mechanism is tied to the dynamic operating impedance of the lamp. A high intensity discharge lamp 50 such as a 50 watt metal halide lamp becomes very unstable if the resonant point is allowed to approach 180 Hz. On the other hand, the low vapor pressure fluorescent provides the best performance when the resonant point is approximately 120 Hz which is the second harmonic.

The critical aspect of the choosing of the current resonant point is based upon the fact that the DC choke 110 provides a buffer or provides a means of giving higher frequency components isolation from the lamp loading effect. When a large amount of energy or wattage is extracted due to the dissipation of the hot lamp, the resonant mechanism is dampened, however, the lamp effective resistance varies. During lamp starting and warmup, this resistance variation adds harmonic current drive stimulation to a relatively high "Q" circuit. Thus, stable operation is enhanced when the odd harmonic resonant points are avoided. It must further be noted that if the resonant point were set at 180 Hz, the open circuit condition voltage which would appear across capacitor 18 and capacitor 16 would be Q times the input voltage peak. This could potentially be as much as 680 volts which may be desirable in some design applications but not in a 50 W metal halide lamp 50 which becomes very unstable as indicated above. Thus, it is very important for stable operation to stay away from the energy odd harmonic resonant points.

The ratio of the impedances $(Lac/c)^{0.5}$, $(Ldc/c)^{0.5}$ and Ldc/rlp are all interactive.

Figure 3:
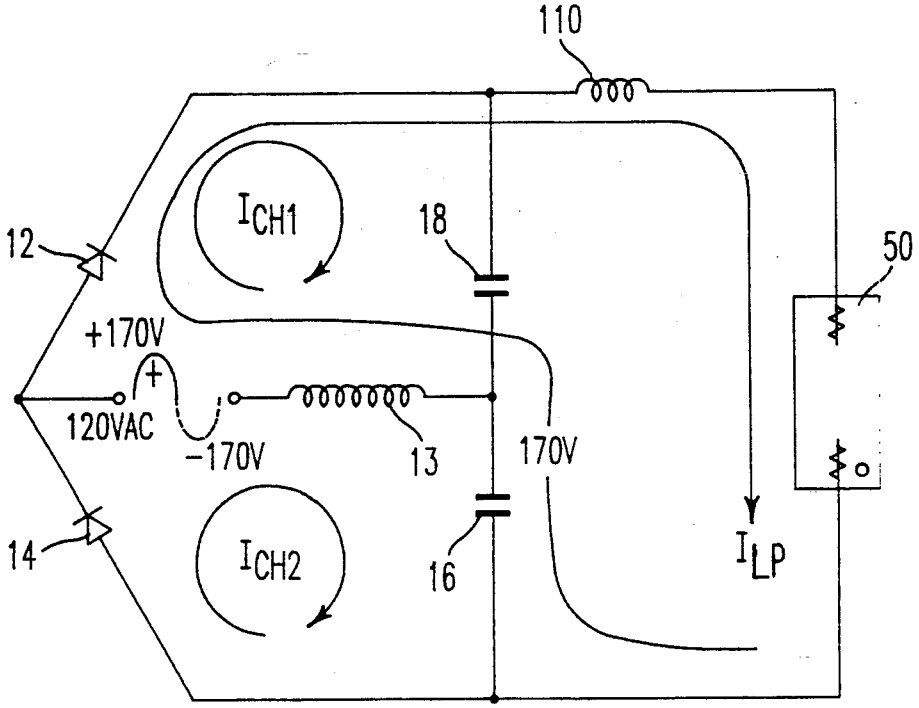
FIG. 3 is a descriptive circuit diagram of the ballast circuit portion of FIGS. 1 and 2 illustrating the ballast circuit operation.

The capacitor 16 in the ballast circuit as shown in FIG. 3 is charged to 170 volts during the negative half cycle which is shown in a dash form. Thus, the power supply for the positive half cycle which creates the lamp current Ilp flow is the positive going source sign wave connected in series with the charged capacitor 16 polarized as shown. The voltage across capacitor 16 through the half cycle goes to zero and is then reversed charged by the energy being returned from the fields of the inductive components 13 and 110. In the following half cycle, as the sign wave source goes negative, the capacitor 16 recharged by Ich2, and the lamp current now flows through diode 14, the source, inductance 13, charge capacitor 18, choke 110 and through the lamp load 50.

This circuit provides a step up of the source voltage to allow a 120 volt AC source to be used to operate lamps that normally require 220 volts to 277 volts of open circuit voltage in order to operate.

The inductance 13 acts as a portion of the lamp ballasting impedance. The other ballasting element which is in the lamp current loop Ilp is generated by the charge reversal of the capacitor 16 or 18 as the source polarity dictates. Inductance 13 also shifts the phase of the charging current making the operating power factor somewhat improved. Furthermore, inductance 13 serves to isolate the diodes 12 and 14 and the capacitor 18 and 16 from the source which carries instantaneous destructive electrical activity such as surges or the rapid changes in current and voltage.

The magnitude of the inductance 13 and the magnitude of the capacitors 18 and 16 are designed to deliver the correct wattage to the lamp load 50 with stable operation based upon the resonant point criteria to achieve stable performance. The selection of the capacitors 18 and 16 dictates the operating lamp wattage to be equal to $(0.5C)\ [V\ \text{charged} + V\ \text{reverse charge}]^2$. The low losses in the inductive elements allow most of the energy placed on the capacitors 18 and 16 to be delivered to the operating lamp 50.

The value of the DC choke inductance 110 is determined by the ability of the choke inductance to store adequate energy to ensure that the flowing lamp current at the level required for the lamp wattage to stay well above zero during the 120 Hz current pulsing.

EXAMPLE 1

The following component values were used for a 50 watt metal halide medium base lamp requiring 85 volts, 0.68 amps, 216 volt minimum open circuit voltage and 3300 to 4000 volt starting pulse:

capacitances 18 and 16 are 7.2 mfd/250 VOLTS rated;

inductance 13 is a 55 volt, 1.1 amp, 50 ohm, 0.1326 henry reactor;

the resonant point calculates to be 160 Hz;

inductance 110 is a 255 milihenry choke having 151 ohms, 0.4 H, 90.5 V, 0.6 amps, 8.6 ohms DC resistance;

diodes 12 and 14 are 3 amps are 400 volts rating.

capacitance 118 is 0.15 mfd and capacitance 112 is 0.0047 mfd and resistor 120 is 680K ohms.

The ballast circuit in the FIGS. 1-3 shows a tap (15) on the inductor 13. If the source is connected to 15 and the design drives the lamp at rated wattage by connecting the source to extension turns (increasing inductance of 13), lamp dimming will occur.

Figure 4:
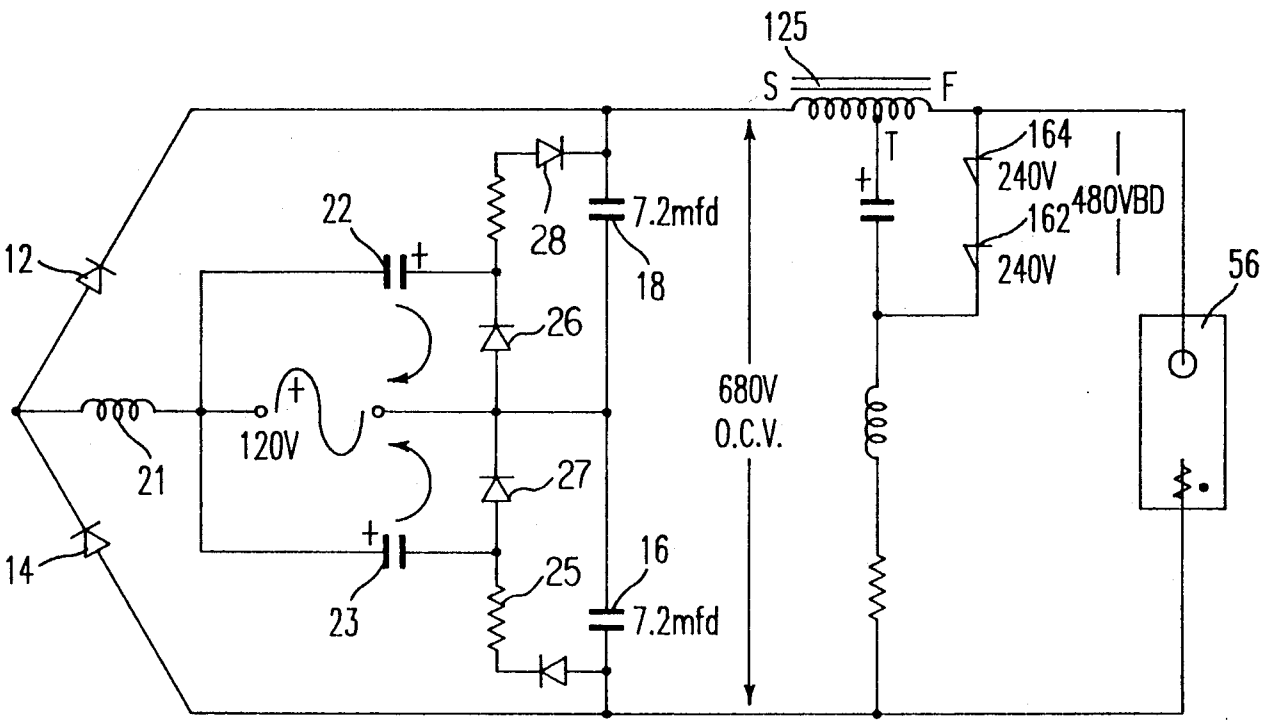
FIG. 4 is a schematic diagram of the electronic d-c ballast circuit including a restrike circuit for providing instant hot restrike.

The basic DC electronic ballast approach of the FIGS. 1-3 provides energy transformation from a 120 volt AC source to a high voltage operation discharge lamp and can also be used to operate fluorescent lamps between 20 and 100 watts as well as a 175 mercury HID lamp. Modifications known to those skilled in art are necessary to operate a fluorescent lamp or a mercury lamp which, for example, does not require a starter. FIG. 4 shows an electronic DC ballast circuit having additional circuitry which is used to cause the lamp to instantly hot restrike. The circuit utilizes diodes 26 and 28, capacitor 22 and resistor 24 to form a voltage doubler which drives the normal DC open circuit voltage across capacitor 18 (170 volts) up to 340 volts. The capacitor 18 is rapidly charged by means of the diode 12 to a 170 volt value. The circuit consisting of diodes 27 and 29, capacitor 23 and resistor 25 perform as a voltage doubler for the capacitor 16 in a manner similar t o the doubler circuit for the capacitor 18. The required values of capacitor and resistor pairs 22, 24 and 23, 25 along with the diode current ratings may be adjusted to provide the intermediate energy required to cause the lamp to ignite and establish a thermal arc effectively. This circuitry can also be used to stabilize and sustain higher reignition voltage operating lamps. Normally the value of capacitors 22 and 23 is between 0.15 to 0.22 mfd and the magnitude of resistors 24 and 25 is approximately 1000 ohms. In order to provide increased energy through the higher requirements open circuit voltage (680), the magnitudes of capacitors 22 and 23 can be made on the order of microfarads and the values of resistors 24 and 25 made very low with higher wattage ratings.

Figure 5:
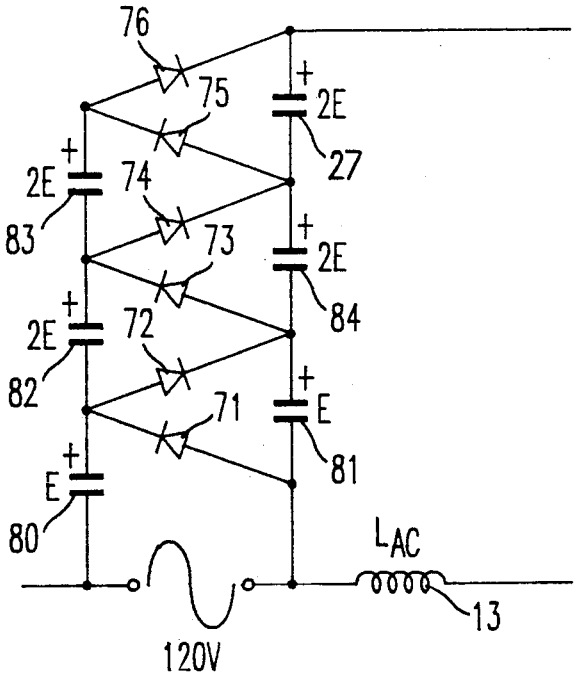
FIG. 5 is a variation of the hot restrike circuit of FIG. 4 for increased higher re-ignition voltage operating lamps by providing a increased open circuit voltage.

The open circuit voltage multiplication concept of FIG. 4 can be increased by adding capacitors 80-85 and diodes 71-76 to form a MARXS generator as shown in the FIG. 5.

As seen in the FIGS. 4 and 5, the basic circuitry of the FIGS. 1-3 provides a flexibility based on the requirements of the lamp being driven with respect to starting and sustaining arcs and thus the present invention has brought application potential with new lamp designs having high wall loading, etc.

The sidacs have their listed breakdown voltage as 480 volts but 500 to 600 volts breakdown is easily obtained by providing a series connection of sidacs. The energy required to fully ionized an operating lamp and force its dynamic impedance down is dictated by the value of capacitance 154 with, for example, the value being 5 mfd with a 600 watt starter for a 510 volt breakdown.

If higher voltage is required to meet the ignition needs of a particular lamp, the sidac breakdown voltage would be increased in the manner indicated above with respect to the series connection and the value of capacitor 118 would be increased to provide this required voltage.

Figure 6:
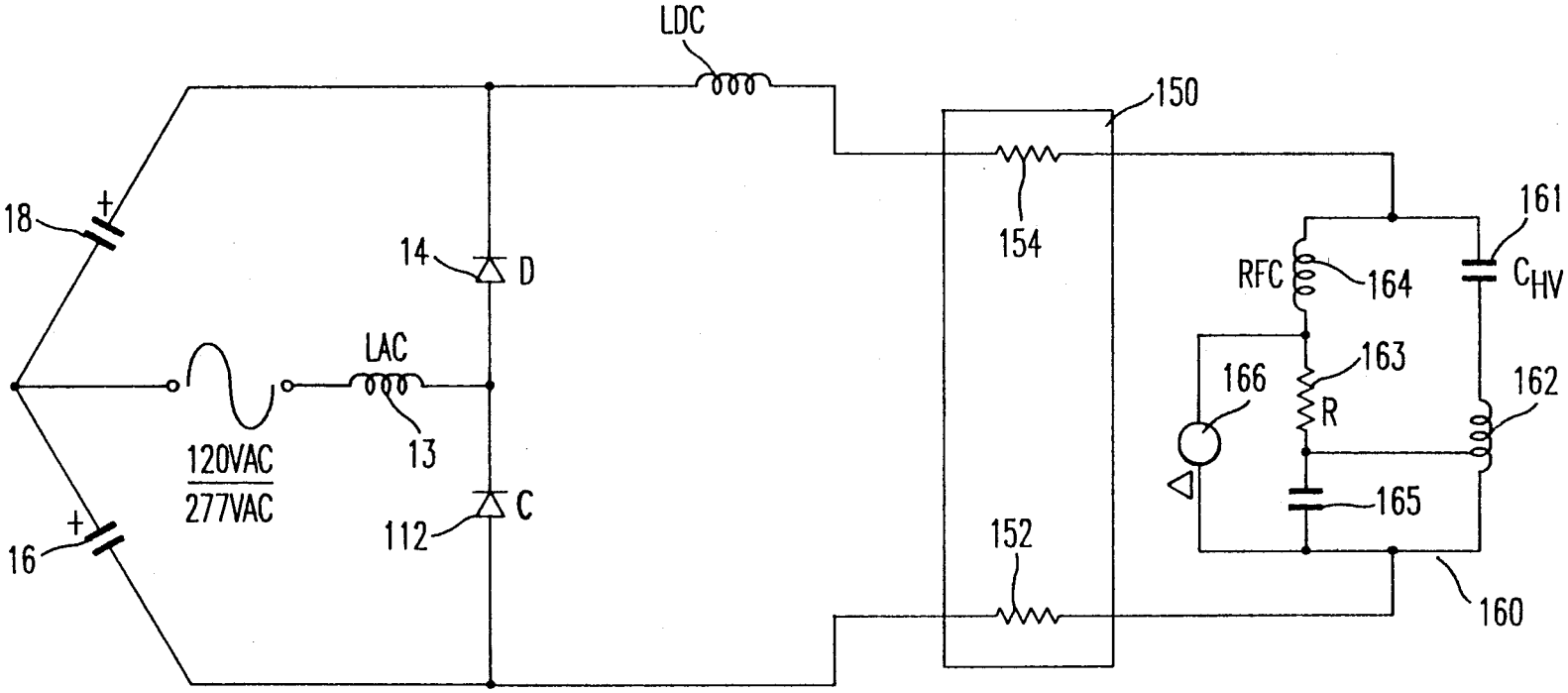
FIG. 6 is yet another embodiment of an ignitor circuit in conjunction with a ballast circuit.

FIG. 6 illustrates an alternate arrangement which is particularly useful for series connected fluorescent lamps or higher voltage lamps which may require the use of 277 V input design. The structure involves an arrangement wherein the fluorescent lamp 150 is placed between the ballast circuit and the starter 160 with the starter being structured with series connection of the high voltage coupling capacitor 161 and the high voltage post transformer 162 which provides for the amplification by means of the turn ratio. The SIDAC switch 166 and the capacitor 165 as well as the resistor 163 are connected in conjunction with the radio frequency choke 164 in a manner similar to the embodiment of FIG. 1 with respect to the starter. Fluorescent lamp 150 has first and second filaments 152 and 154 connected in the manner shown between the ballast circuit and the starter circuit in order to complete the circuit loop through the current smoothing circuit 110.

Figure 7:
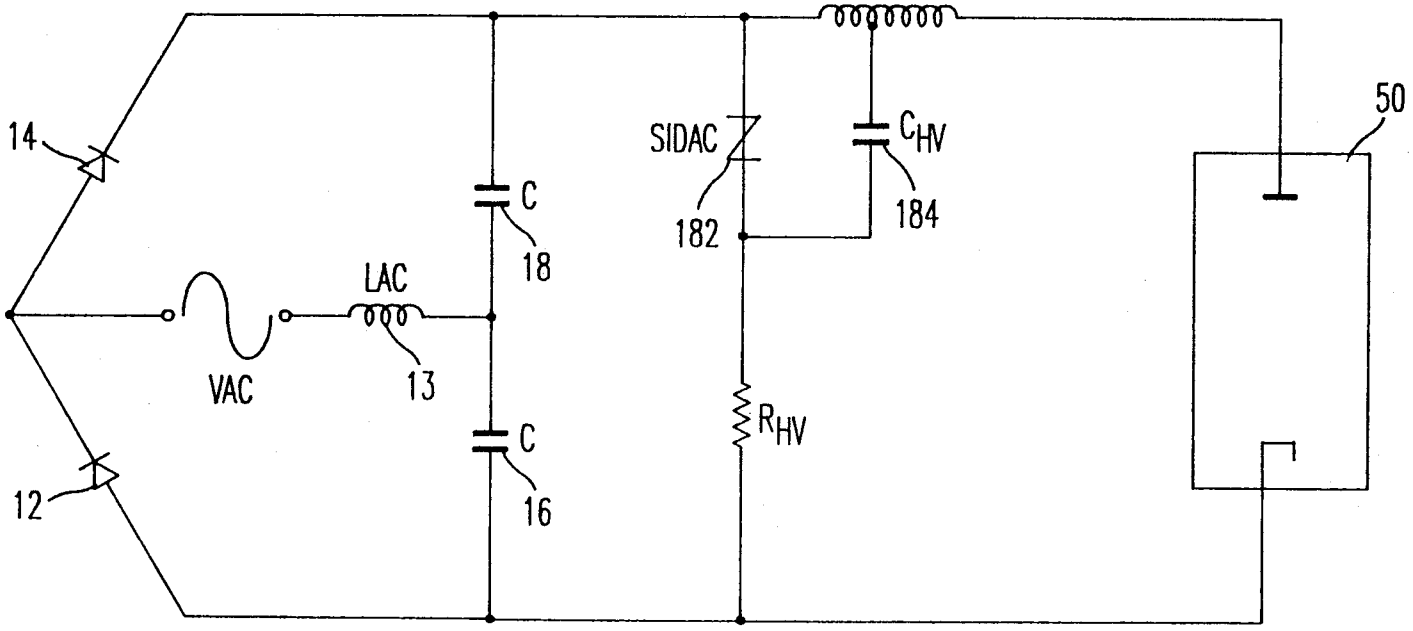
FIG. 7 is a three part low cost ignitor arrangement according to the present invention.

The FIG. 7 is the simplest and most affordable circuitry available utilizing the concept of the present invention and provides a connection to the tapped portion of the choke 125 connected to the SIDAC 182 through the high voltage coupling capacitor 184 and which is in turn in series with the high voltage resistance 186. The simplicity of the circuit allows for its structure to be obtained with a minimum of separately manufactured parts.

Obviously, numerous modifications and variations of the present invention are possible in light of the above teachings. It is therefore to be understood that within the scope of the appended claims, the invention may be practiced otherwise then as specifically described herein.

What is claimed as new and desired to be secured by Letters Patent of the United States is:

1. A low loss ballast circuit system for operating a high voltage discharge lamp, comprising:

alternating current voltage source input means:

inductance means connected to said input means for receiving said alternating current voltage;

rectifying means including capacitance means connected to said inductance means wherein the output of said rectifying means is an open circuit DC voltage substantially equal to twice the peak value of said alternating current source voltage and wherein the value of said inductance means and said capacitance means is chosen so that a resonant frequency of a combination of said inductance means and said capacitance means is at a value between and spaced from each of second and third harmonics of said alternating current source voltage; and ignitor means connected to receive said open circuit voltage and provide a high voltage ignition pulse to start said lamp and including a means for forcing said started lamp to a low impedance state thereby allow continued operation of said lamp by said open circuit DC voltage.

2. The system according to claim 1 wherein said ignitor means includes a semiconductor breakdown switching device and a high voltage pulse transformer and a capacitance means for blocking both DC voltage current flow and said second harmonic AC voltage current flow in said transformer.

3. The system according to claim 1, wherein said alternating current voltage source is 120 volts AC and wherein said resonant frequency is between 130 and 165 Hz.

4. The system according to claim 1, wherein said lamp is a 50 watt metal halide (MH) lamp having a voltage of 85 volts and having a starting pulse requirement of between 3,300 and 4,000 volts.

5. The system according to claim 1, wherein said rectifier circuit further includes a voltage doubler means connected in parallel with said capacitance means in order to provide an increased open circuit DC voltage.

6. The system according to claim 1, wherein said ignitor means includes an ignitor inductance circuit and a means for tapping a portion of said ignitor inductance circuit, which means for tapping is connected to a voltage breakdown device acting in conjunction with a charging resistor and a radio-frequency choke coil and wherein said breakdown device is connected in parallel with a coupling capacitor for coupling said high frequency pulse and blocking DC and second harmonic current flow.

7. The system according to claim 1, wherein said rectifying means further includes a plurality of additional capacitors and a plurality of additional diodes forming a MARXS generator to provide an increased open circuit voltage.

8. A ballast circuit for operating a high voltage discharge lamp, comprising:

input means for receiving an alternating current voltage source; and rectifying means including an inductance means connected to said input means and a capacitance means connected to said inductance means, wherein the output of said rectifying means is an open circuit DC voltage substantially equal to twice the peak value of said alternating current source voltage and wherein the value of said inductance means and said capacitance means is chosen so that the resonant frequency of a combination of said inductance means and said capacitance means is at a value between and spaced from each of second and third harmonics of said alternating current source voltage.

9. The circuit according to claim 8, wherein said inductance means further includes a means for tapping various points of said inductance means in order to provide a lamp dimming effect.

10. The circuit according to claim 8, wherein said lamp is a fluorescent lamp.

11. The circuit according to claim 8, wherein said lamp is a mercury HID lamp.

12. The circuit according to claim 8, wherein said rectifying means further comprises a voltage doubler means to increase the open circuit voltage in order to provide for instantly hot restrike of said lamp.

* * * * *